US006969117B2

(12) United States Patent
King et al.

(10) Patent No.: US 6,969,117 B2
(45) Date of Patent: Nov. 29, 2005

(54) BACKREST ASSEMBLY FOR A SEATING ARRANGEMENT

(75) Inventors: David Russell King, Turrella (AU); Steven Higgs, Turrella (AU)

(73) Assignee: King Furniture Pty Ltd., Turrella (AU)

( * ) Notice: Subject to any disclaimer, the term of this patent is extended or adjusted under 35 U.S.C. 154(b) by 0 days.

(21) Appl. No.: 10/665,272

(22) Filed: Sep. 17, 2003

(65) Prior Publication Data

US 2004/0100135 A1 May 27, 2004

(30) Foreign Application Priority Data

Sep. 18, 2002 (AU) ..... 2002951475

(51) Int. Cl.[7] ..... A47C 7/40
(52) U.S. Cl. ..... 297/353
(58) Field of Search ..... 297/353, 232, 297/284.1, 230.14, 284.7

(56) References Cited

U.S. PATENT DOCUMENTS 192,809 A * 7/1877 Burritt ..... 297/335
2,603,275 A * 7/1952 Kuebler ..... 297/353
3,147,038 A * 9/1964 Barabas ..... 297/89
4,401,343 A * 8/1983 Schmidt ..... 297/284.1
4,834,455 A * 5/1989 Proctor ..... 297/353
4,981,325 A * 1/1991 Zacharkow ..... 297/353
5,695,251 A * 12/1997 Scolari ..... 297/408
6,095,606 A * 8/2000 Opsvik ..... 297/353
6,158,810 A * 12/2000 Galloway ..... 297/353
6,540,296 B1 * 4/2003 Shats et al. ..... 297/353

* cited by examiner

*Primary Examiner*—Peter R. Brown
(74) *Attorney, Agent, or Firm*—D. Peter Hochberg; Sean Mellino; Katherine R. Vieyra

(57) ABSTRACT

A seating arrangement comprise a seat base. A seat back extends upwardly from the seat base. A backrest is displaceably arranged relative to the seat base between a first, retracted position in which the backrest is substantially in register with the seat base and a second, extended position in which at least a part of the backrest protrudes upwardly beyond a top edge of the seat back. A displacement mechanism is arranged between the seat back and the back rest, the displacement mechanism effecting displacement of the backrest from its first position to its second position.

9 Claims, 2 Drawing Sheets

BACKREST ASSEMBLY FOR A SEATING ARRANGEMENT

FIELD OF THE INVENTION

This invention relates to a seating arrangement. More particularly, the invention relates to a backrest assembly for a seating arrangement.

BACKGROUND TO THE INVENTION

Certain modern, upholstered items of furniture have low backrests. While conveying an attractive appearance to the item of furniture, prolonged sitting in such furniture can cause discomfort due to lack of support of an occupant's back. Incorrect lumbar support can also result in medical complications, particularly with people suffering from back problems.

SUMMARY OF THE INVENTION

According to the invention; there is provided a seating arrangement which comprises:

a seat base;

a seat back extending upwardly from the seat base;

a backrest displaceably arranged relative to the seat base between a first, retracted position in which the backrest is substantially in register with the seat base and a second, extended position in which at least a part of the backrest protrudes upwardly beyond a top edge of the seat back; and a displacement mechanism arranged between the seat back and the backrest, the displacement mechanism effecting displacement of the backrest from its first position to its second position.

In a preferred embodiment of the invention, the seating arrangement is in the form of lounge furniture. For example, the seating arrangement may be an armchair, a couch or sofa, or the like. It will be appreciated that such furniture is normally upholstered, padded furniture.

Further, such furniture normally has framework supporting the upholstery. Accordingly, the seat base, the seat back and the backrest may each comprise an upholstered frame. At least the seat back frame and the backrest frame may each be box frames. If desired, the backrest frame may carry a suspension assembly for increasing the comfort of the backrest.

The seating arrangement may include a locking mechanism, the locking mechanism locking the backrest in at least its first position relative to the seat base. The locking mechanism may include an engageable member, in the form of a locking pin, carried on one of the seat back and the backrest, the other of the seat back and the backrest carrying an engaging member, in the form of a catch plate, which engages the engageable member when the backrest is in its first position relative to the seat back. Preferably, the locking pin is carried on the frame of the backrest with the catch mechanism being carried on the frame of the seat back.

The seating arrangement may include an operating mechanism that operates the engaging member for releasing the engageable member. This enables the backrest to rise relative to the seat back to its second, extended position under the effect of the displacement mechanism. The operating mechanism may be a concealed operating mechanism that includes a release cable, co-operating with the locking mechanism, and a handle concealed beneath or beside a cushion on the seat base.

The displacement mechanism may be a fluid operated displacement mechanism. More particularly, the fluid operated displacement mechanism may be in the form of at least one pneumatic piston/cylinder assembly.

The seating arrangement may include a guide means, the guide means guiding the displacement of the backrest relative to the seat back. The guide means may comprise at least one and, preferably, a pair of guide shafts extending in the direction of displacement of the backrest relative to the seat back. A guide sleeve may be slidably arranged on the, or each, guide shaft. Preferably, the, or each, guide shaft is carried on the frame of the seat back with the, or each, sleeve being carried on the frame of the backrest. Where a pair of guide shafts and sleeves are provided, the guide shafts may be transversely spaced with respect to each other.

Preferably, the displacement mechanism is a concealed displacement mechanism interposed between the seat back and the backrest, the displacement mechanism permitting reversible displacement of the backrest from its first position to its second position.

BRIEF DESCRIPTION OF THE DRAWINGS

The invention is now described by way of example with reference to the accompanying diagrammatic drawings in which.

DETAILED DESCRIPTION OF THE PREFERRED EMBODIMENT

Figure 1:
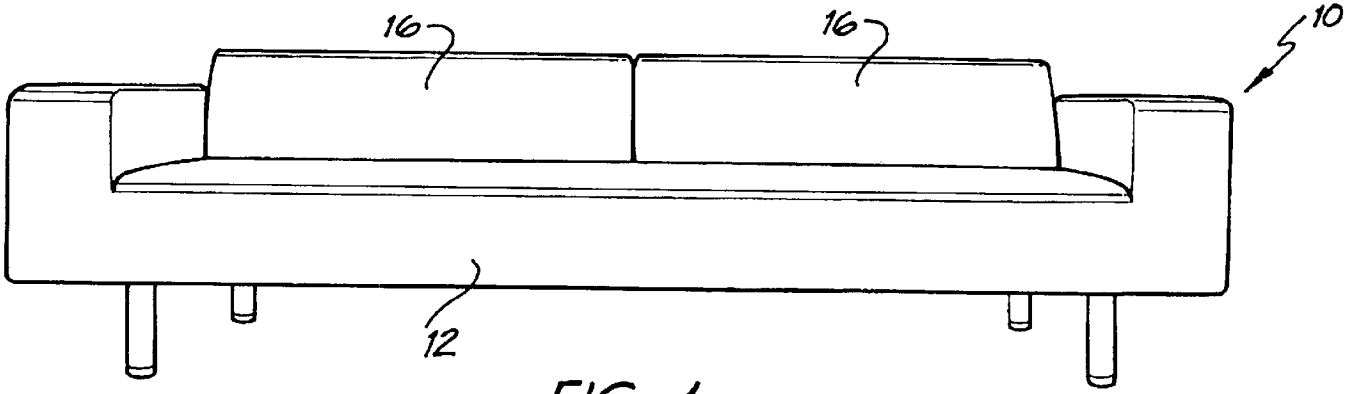
FIG. 1 shows a three-dimensional, front view of a seating arrangement in accordance with an embodiment of the invention.

In the drawings, reference numeral 10 generally designates a seating arrangement, in the form of a sofa, in accordance with an embodiment of the invention. The sofa 10 comprises a seat base 12. A seat back, which is indicated at 14 in FIG. 2 of the drawings, extends upwardly from a rear edge of the seat base 12.

A backrest 16 is displaceably arranged relative to the seat back 14. In the illustrated embodiment, the sofa 10 has two independently displaceable backrests 16. The seat back 14 is, correspondingly, divided into two parts, one associated with each backrest 16. It will be appreciated, however, that the invention is equally applicable to seating arrangements having a one-piece seat back and/or backrest.

Figure 2:
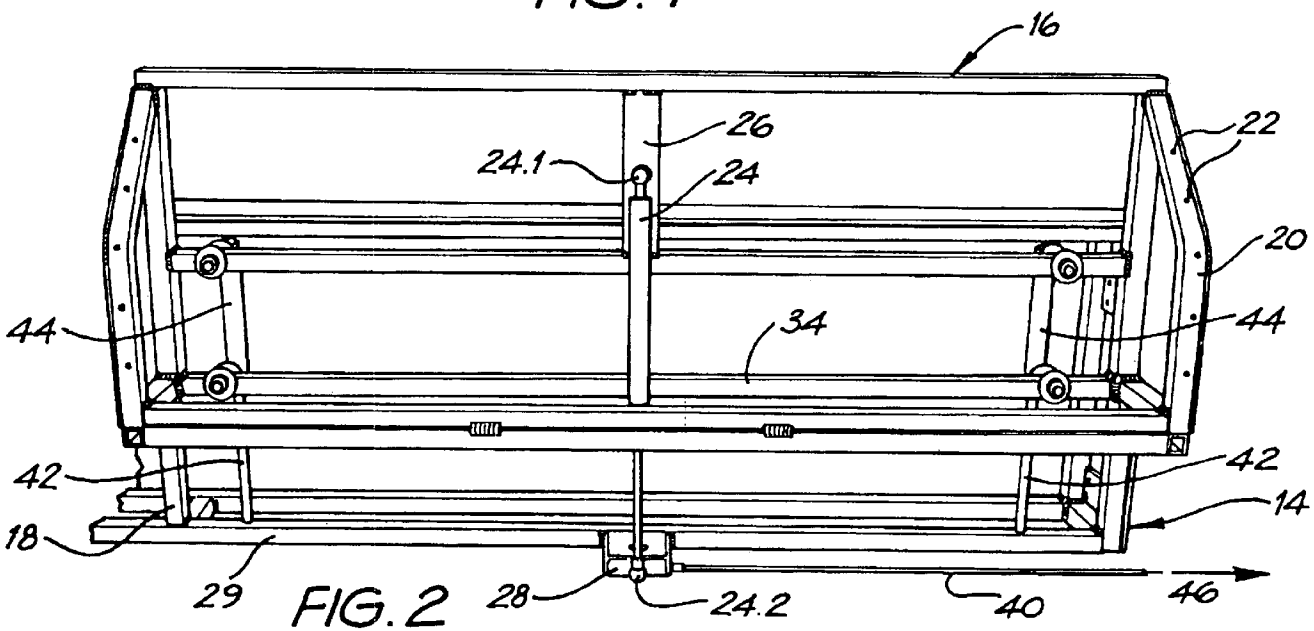
FIG. 2 shows a three-dimensional, front view of a part of the seating arrangement of FIG. 1.

As illustrated more clearly in FIG. 2 of the drawings, each part of the seat back 14 has a box frame 18 carrying padding and upholstery (not shown). Similarly, each backrest 16 has a shaped box frame 20 which carries padding and upholstery. In addition, the frame 20 of each backrest 16 carries a suspension assembly anchored at points 22. The suspension assembly is omitted for the sake of clarity but is a commercially available suspension assembly such as that sold under the Registered Trade Mark, Pullmaflex (Pullmaflex is a Registered Trade Mark of Leggett-Platt Inc., a USA company).

Each backrest 16 is displaceably arranged relative to its associated part of the seat back 14 between a first, retracted position in which a bottom of the backrest 16 is received between the seat base 12 and the seat back 14 and a second, extended position, as shown in FIG. 2 of the drawings, where a top of the backrest 16 stands proud of, and extends above, a top of the seat back 14.

The sofa 10 includes a fluid-operated displacement mechanism in the form of a pneumatic piston/cylinder assembly 24. A piston/cylinder assembly 24 is associated with each backrest 16 and is interposed between the backrest 16 and its associated seat back 14. One end 24.1 of the piston/cylinder assembly 24 is secured to a gusset plate 26 at a rear of the frame 20 of the backrest 16. An opposed end 24.2 of the assembly 24 is secured to a housing 28 on a cross member 29 at a bottom of the front of the frame 18 of the seat back 14.

The housing 28 houses a locking mechanism 30 (FIG. 3) which locks the backrest 16 in its retracted position relative to the seat back 14.

Figure 3:
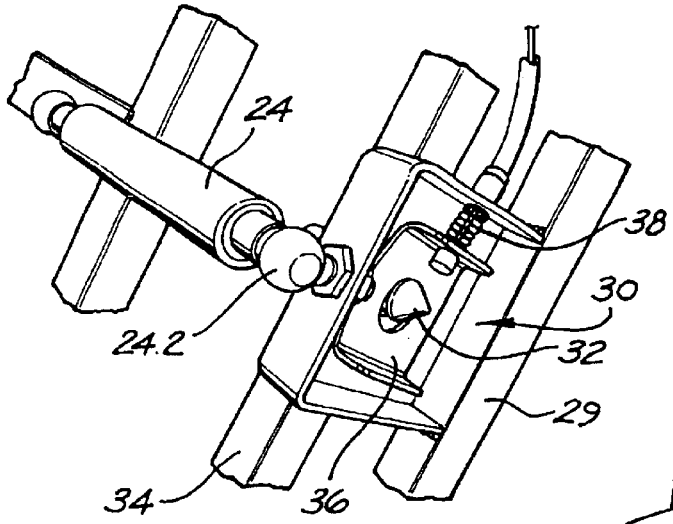
FIG. 3 shows a three-dimensional, bottom view of a locking mechanism of the seating arrangement.
Figure 5:
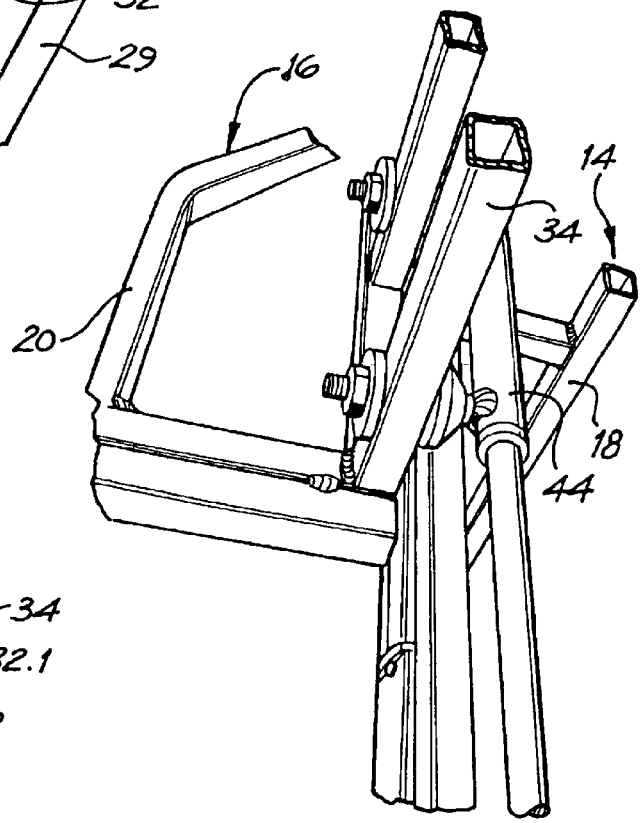
FIG. 5 shows a three-dimensional view of a guide means of the seating arrangement.
Figure 4:
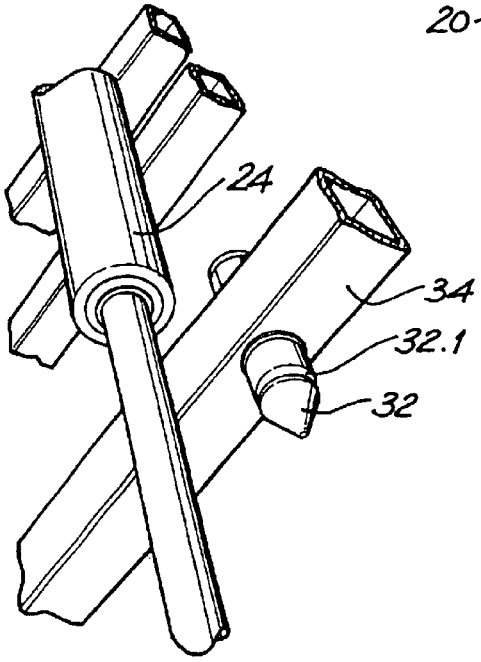
FIG. 4 shows a three-dimensional view of a displacement mechanism of the seating arrangement.

The locking mechanism 30 includes a locking pin 32 (FIGS. 3 and 4) carried on a cross member 34 of the frame 20 of the backrest 16. The locking pin 32 has a circumferential groove 32.1 formed in its periphery. A catch plate 36 is pivotally mounted in the housing 28 to pivot in a plane in which the catch plate 36 lies. An urging means, in the form of a spring 38, biases the catch plate 36 towards one side of the housing 28, as shown in FIG. 3 of the drawings, so that the catch plate 36 is received in a part of the groove 32.1 of the locking pin 32 in a rest position of the catch plate 36.

An operating mechanism, comprising a cable 40 and a handle (not shown), acts on the locking mechanism 30. One end of the cable 40 is secured to the catch plate 36 with the other end of the cable 40 being secured to the handle. The cable 40 and the handle are concealed behind or beneath a cushion of the seat base 12 of the sofa 10.

A pair of transversely spaced guide bars 42 of a guide means is carried on the frame 18 of the seat back 14. Each guide bar 42 slidably receives a sleeve 44, carried on the frame 20 of the backrest 16. The guide bars 42 and guide sleeves 44 serve to inhibit skewing of the backrest 16 relative to the seat back 14 as the backrest 16 is displaced relative to the seat back 14.

In use, the backrest 16, in its retracted position, lies substantially in register with the seat back 14 to provide a modern, low-backed appearance to the sofa 10. The backrest 16 is held in its retracted position by the catch plate 36 of the locking mechanism 30 engaging the groove of the locking pin 32.

When it is desired to support a higher lumbar region of a person's back, when the person is seated on the sofa 10, the operating mechanism is operated. This is effected by pulling the cable 40 in the direction of arrow 46. When this occurs, the catch plate 36 is pivoted against the action of the spring 38 to clear the groove of the locking pin 32 to release the locking pin 32. The backrest 16 rises under the action of the pneumatic piston/cylinder assembly 24 to the position shown in FIG. 2 of the drawings.

In this position, the backrest 16 supports the person's back in a higher region of the person's back.

When it is desired to return the backrest 16 to its retracted position 14, pressure is applied to the top of the backrest 16 to urge the backrest 16 downwardly, against the action of the piston/cylinder assembly 24, until the locking pin 32 is engaged and is locked by the locking plate 36.

It is a particular advantage of the invention that a seating arrangement 10 is provided which, while having an attractive, modern appearance when the backrest 16 is in a retracted position, provides a more orthopaedically suitable support when the backrest 16 is in a raised position relative to the backrest 14. The use of the pneumatic piston/cylinder assembly 24 provides an appealing, damped motion to the backrest 16 when it rises relative to the seat back 14. Further, the use of this assembly 24 reduces the effort required to raise the backrest 16 relative to the seat back 14 and facilitates the returning of the backrest 16 to its retracted position.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A seating arrangement which comprises:

a seat base;

a seat back extending upwardly from the seat base, the seat back comprising an upholstered box frame;

a backrest comprising an unholstered box frame, the backrest being displaceably arranged relative to the seat base between a first, retracted position in which the backrest is substantially in register with the seat back and a second, extended position in which at least a part of the backrest protrudes upwardly beyond a top edge of the seat back; and a fluid-operated displacement mechanism arranged in a concealed location between the seat back and the backrest, the displacement mechanism effecting displacement of the backrest from its first position to its second position, at least a part of the displacement mechanism being carried within the box frame of the backrest.

2. The seating arrangement of claim 1 in which the seat base, also comprises an upholstered frame.

3. The seating arrangement of claim 1 which includes a locking mechanism, the locking mechanism locking the backrest in at least its first position relative to the seat back.

4. The seating arrangement of claim 3 in which the locking mechanism includes an engageable member carried on one of the seat back and the backrest, the other of the seat back and the backrest carrying an engaging member which engages the engageable member when the backrest is in its first position relative to the seat back.

5. The seating arrangement of claim 4 which includes an operating mechanism that operates the engaging member for releasing the engageable member.

6. The seating arrangement of claim 5 in which the operating mechanism is a concealed operating mechanism.

7. The seating arrangement of claim 1 in which the fluid operated displacement mechanism is in the form of at least one pneumatic piston/cylinder assembly.

8. The seating arrangement of claim 1 which includes a guide means, the guide means guiding the displacement of the backrest relative to the seat back.

9. The seating arrangement of claim 1 in which the displacement mechanism is interposed between the seat back and the backrest, the displacement mechanism permitting reversible displacement of the backrest from its first position to its second position.

* * * * *